US007447457B2

(12) United States Patent
Tose

(10) Patent No.: US 7,447,457 B2
(45) Date of Patent: Nov. 4, 2008

(54) IMAGE FORMATION APPARATUS, CONTROL METHOD OF OPERATION SCREEN DISPLAY, AND CONTROL PROGRAM OF OPERATION SCREEN DISPLAY

(75) Inventor: Masahiro Tose, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/122,632

(22) Filed: May 5, 2005

(65) Prior Publication Data

US 2006/0093389 A1 May 4, 2006

(30) Foreign Application Priority Data

Nov. 4, 2004 (JP) ..... 2004-321184

(51) Int. Cl.
*G03G 15/00* (2006.01)

(52) U.S. Cl. ..... 399/81

(58) Field of Classification Search ..... 399/81
See application file for complete search history.

(56) References Cited

U.S. PATENT DOCUMENTS 4,090,787 A * 5/1978 Hubbard et al. ..... 399/20
4,907,150 A * 3/1990 Arroyo et al. ..... 713/323
5,375,230 A * 12/1994 Fujimori ..... 713/323
5,404,544 A * 4/1995 Crayford ..... 713/310
5,594,672 A * 1/1997 Hicks ..... 713/321
5,642,185 A * 6/1997 Altrieth et al. ..... 399/81
5,666,539 A * 9/1997 Kenkel ..... 713/320
7,313,341 B2 * 12/2007 Matsusaka ..... 399/88
2005/0180769 A1 * 8/2005 Morioka et al. ..... 399/75

FOREIGN PATENT DOCUMENTS

| | | | |
|---|---|---|---|
| JP | 1154169 | | 6/1989 |
| JP | 5333618 | | 12/1993 |
| JP | 2002229395 | A * | 8/2002 |
| JP | 2003163772 | | 6/2003 |
| JP | 10-2005-0044413 | | 7/2006 |

OTHER PUBLICATIONS

Office Action Application No. 200510079003X (5 pgs.) from the Chinese Patent Office with English translation (3 pgs.).

* cited by examiner

*Primary Examiner*—David M Gray
*Assistant Examiner*—Bryan Ready
(74) *Attorney, Agent, or Firm*—Gauthier & Connors LLP

(57) ABSTRACT

An image formation apparatus has a timer, a reset unit and a controller. The timer measures time for a non-operation state of an operation screen. The reset unit initializes a setting of the operation screen when the non-operation state of the operation screen continues for a predetermined period. The controller inhibits the reset unit from executing the initialization when an execution file which cooperates with an external device is executed or data are exchanged with the external device, even if the non-operation state of the operation screen continues for the predetermined period.

14 Claims, 2 Drawing Sheets

IMAGE FORMATION APPARATUS, CONTROL METHOD OF OPERATION SCREEN DISPLAY, AND CONTROL PROGRAM OF OPERATION SCREEN DISPLAY

BACKGROUND OF THE INVENTION

1. Field of the Invention

The present invention relates to an image formation apparatus having an operation screen for allowing a user to input conditions for use, and a reset unit for initializing settings input from the operation screen when a non-operation state of the operation screen continues for a predetermined period, and in particular to an apparatus and method affording enhanced convenience to a user.

2. Description of the Related Art

Many image formation apparatuses are provided with an automatic clear function in which set parameters and display state are reinitialized when a non-operational state continues for a predetermined period of time, and/or a power save function in which supply of power to an operation panel or the like is stopped in order to reduce power consumption when a non-operational state continues for a predetermined period. The predetermined periods before these functions are activated can be set by users such as the administrator of the apparatus, and may be set to a relatively short period, as best fits usage patterns. In the present specification, the functions such as the automatic clear function and power save function which initialize the settings from the operation screen with elapse of a predetermined period will hereinafter be called "reset units."

However, when such a reset unit is unconditionally activated after the elapse of a predetermined period, situations that are inconvenient to operators frequently arise. For example, settings input by a current user may be initialized while they are using the apparatus, forcing the operator to repeat setting operations. To address this problem, in one related art apparatus, the reset unit can be controlled such that the reset unit is not unconditionally activated (see, for example, Japanese Patent Laid-Open Publication Nos. Hei 1-154169 and Hei 5-333618).

In recent years, with enhancement of added value of image formation apparatuses, there have been developed apparatuses which have functions that can cooperate with an external device through, for example, a communication line or the like. Forexample, a browser can be provided in an image formation apparatus so that data can be obtained from an external device, and a process request can be sent to an external device and a setting screen provided by an external device can be displayed on an operation panel of the image formation apparatus.

However, the time required to perform operations related to cooperation with the external device is not necessarily dependent solely on the performance of the image formation apparatus, but may also depend on other external factors, such as of the operational load of the external device and the bandwidth and state of activity of the communication line. Therefore, even if the predetermined period for which the reset unit is to be activated is appropriately set in consideration of the performance of the image formation apparatus, the predetermined period for the reset unit to be activated may elapse due to external factors before completion of setting of conditions, such as the setting of parameters using the operation screen. For example, when image data to be stored are to be designated and the storage destination folder is then to be designated in order to store, in an external device, image data which are read by means of a scan function of the image formation apparatus, if the time required for obtaining the folder structure of the external device which is the storage destination exceeds the predetermined period due to reasons such as a heavy load on the communication line, the settings regarding the image data which are input prior to the designation of the folder are reset in response to activation of the reset unit.

As described, the user may experience inconvenience when a reset unit such as an automatic clear function or a power save function is unconditionally activated after elapse of the predetermined period because of an external factor.

SUMMARY OF THE INVENTION

The present invention was made in view of the above circumstances and provides an image formation apparatus, and a control method and a control program of an operation screen display, which prevents the user from being inconvenienced when the device cooperates with an external device during setting of conditions through an operation screen.

According to one aspect of the present invention, there is provided an image formation apparatus having a timer for measuring the length of a non-operation state of an operation screen and a reset unit for initializing a setting from the operation screen when the non-operation state of the operation screen continues for a predetermined period, the image formation apparatus comprising a controller which inhibits the reset unit if an execution file which cooperates with an external device is being executed or data are being exchanged with the external device when the non-operation state of the operation screen continues for the predetermined period.

BRIEF DESCRIPTION OF THE DRAWINGS

An embodiment of the present invention will be described in detail by reference to the drawings, wherein.

DETAILED DESCRIPTION OF THE INVENTION

Figure 1:
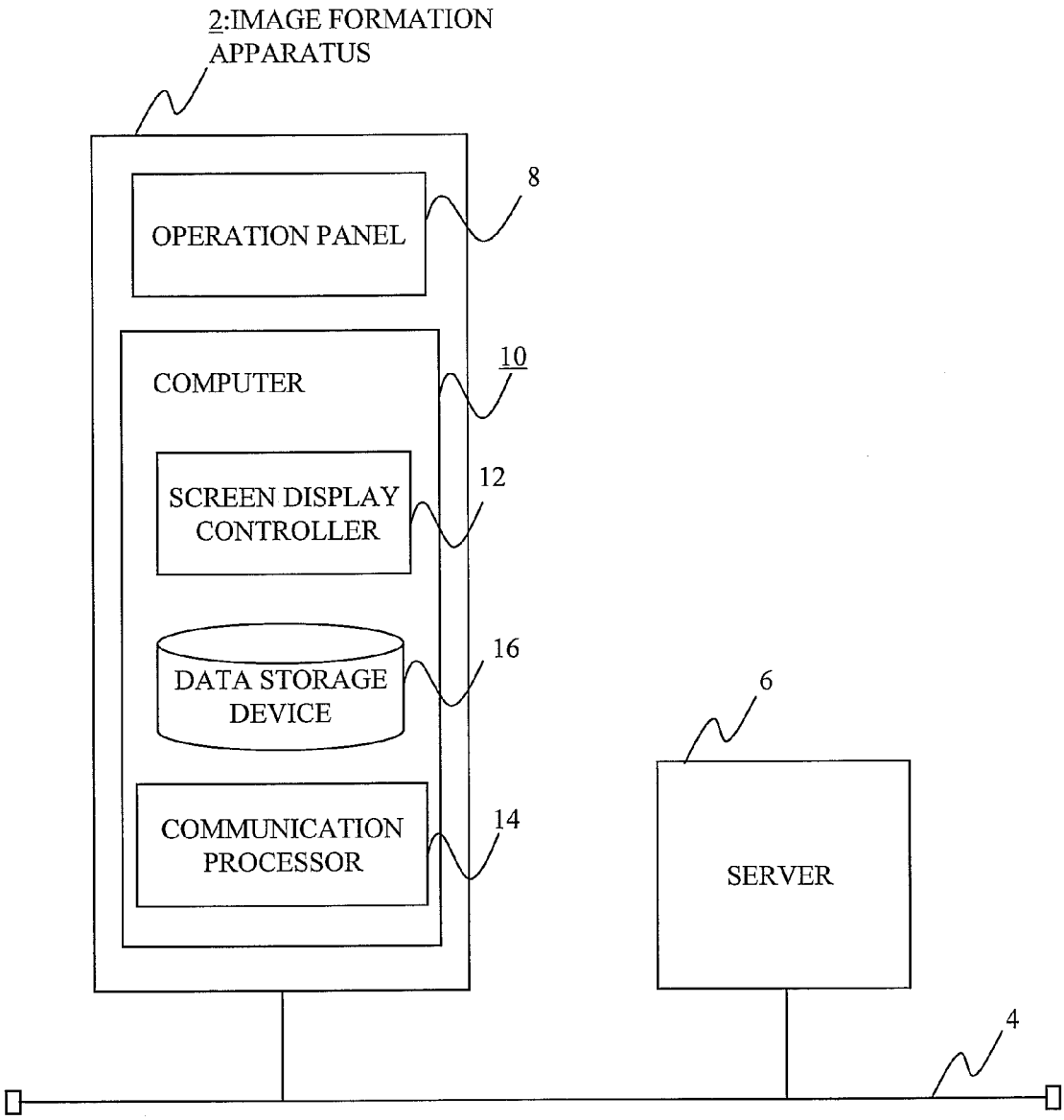
FIG. 1 is a diagram showing the structure of a network system including an image formation apparatus according to an aspect of the present invention.

An embodiment of the present invention will now be described referring to the drawings.

FIG. 1 is a diagram showing the structure of a network system having an image formation apparatus according to an aspect of the present invention. FIG. 1 shows an image formation apparatus 2, and a server 6 which exchanges data with the image formation apparatus 2 via a network 4. The network 4 may be a closed network, such an intranet, or an open network such as the Internet.

In the embodiment, the image formation apparatus 2 is a multifunction device having functions such as a copy function, a facsimile function, a scanner function, etc. The image formation apparatus 2 has a function (reset unit) for initializing, after elapse of a predetermined period, settings of the image formation apparatus 2 which are set from an operation panel, such as an automatic clear function for initializing set parameters and a display state when a non-operation state of the operation panel 8 continues for a predetermined period and a power save function for stopping supply of power to the operation panel or the like in order to reduce power consumption. The predetermined period refers to the length of time from the last instance of the user operating the operation panel 8 to the point when the reset unit is activated, and is set by an administrator or the like of the apparatus. The predetermined period will also be referred to as "timer period." Moreover, a computer 10 in the image formation apparatus 2 executes, in addition to the processes inherently as an image formation apparatus, network communication processes and characteristic processes of the present embodiment to be described below.

The computer 10 comprises a screen display controller 12, a communication processor 14, and a data storage device 16. The screen display controller 12 controls display of various setting screens on an operation panel 8 of the image formation apparatus 2. For example, when a copy function is performed, in addition to display of a setting screen for the functions that are conventionally available, such as setting of the paper size and setting of a number of copies, the screen display controller 12 executes a process according to the description of an execution file obtained from an external device to display an arbitrary setting screen. The screen display controller 12 obtains an execution file from an external device and reference data such as image data designated in the execution file and stores the same in the data storage device 16. The communication processor 14 executes a data communication process with the external device as described above via the network 4. The processing functions in the screen display controller 12 and the communication processor 14 are realized by cooperation between the computer 10 and software which realizes the processing functions.

Figure 2:
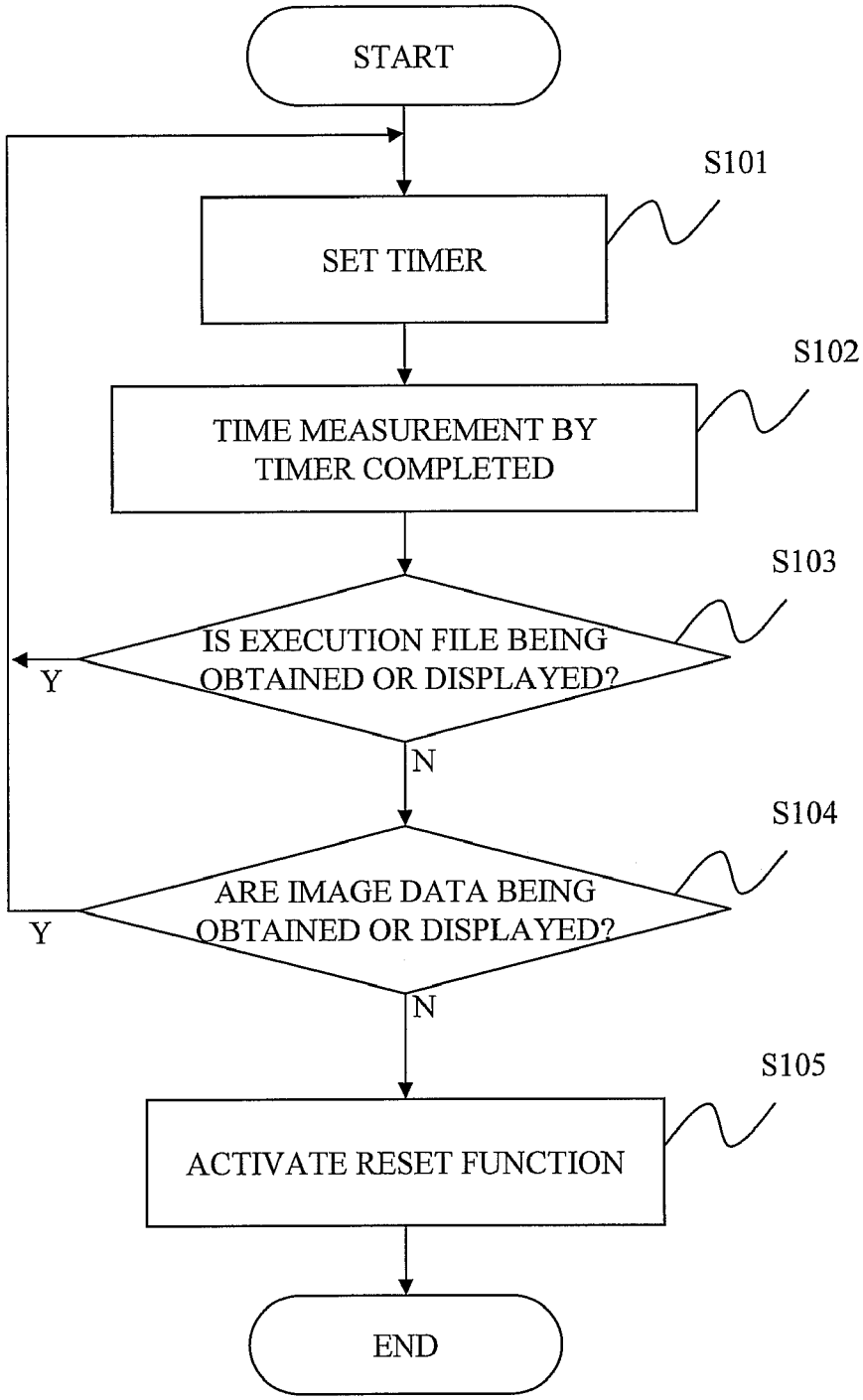
FIG. 2 is a flowchart showing an operation in the image formation apparatus according to an aspect of the present invention when a non-operation state continues.

Next, an operation in the present embodiment will be described by reference to a flowchart shown in FIG. 2. According to the embodiment, an HTML (Hyper Text Markup Language) file is obtained from the server 6 as an example execution file used for forming the display content of the operation screen 8, and an operation screen desired for the user is displayed on the operation panel 8 by means of processing the HTML file.

A user requests the server 6 to acquire the HTML file by operating the operation panel 8. In response to an operation such as the pressing of a button displayed on the operation panel 8, a timer of the reset unit is reset and time measurement is started (step S101). In response to the acquisition request transmitted from the image formation apparatus 2, the server 6 returns the designated HTML file to the user. Normally, the user remains present in front of the image formation apparatus 2 until the HTML file is returned from the server 6 and displayed on the operation panel 8. As described above, this wait time varies and is dependent on the performance of the server 6 and the load state of the network 4. When an operation is performed before completion of time measurement by the timer or when the reception of the HTML file is completed before completion of the time measurement by the timer, the image formation apparatus 2 continues to execute normal processing functions.

When a non-operational state of the operation pane 8 continues for a predetermined timer period, time measurement by the timer of the reset unit of the image formation apparatus 2 is completed (step S102). At this point, the screen display controller 12 checks whether or not the HTML file is being obtained from an external device (in this case, the server 6) and the display is being realized (step S103). Specifically, while the screen display controller 12 is displaying the setting screen on the operation panel 8 while obtaining the HTML file from the server 6, the screen display controller 12 determines whether or not the process being executed is acquisition of the HTML file or whether or not the display is being executed according to the description of the HTML file, by identifying the file type. In this embodiment, the file is an HTML file, so that the reset unit is not activated and the timer is reset and returned to the time measuring operation (step S101). Therefore, even if the timer period elapses, the operation screen displayed on the operation panel 8 is not reset. In other words, the operation screen is not reset until the HTML file is obtained and execution of the HTML file is completed, which is convenient for the user.

There may be instances in which a setting screen is completed by acquiring the HTML file and also by obtaining image data or the like in accordance with the description of the HTML file. Therefore, in some instances, even when execution of the process of the HTML file is completed, the acquisition of reference data such as the image data designated in the HTML file has not been completed. In consideration of such a possibility, step S104 is provided.

Specifically, after the acquisition of the HTML file, the screen display controller 12 processes the HTML file to transmit, to the server 6, an acquisition request of image data designated in the description of the HTML file. In response to the acquisition request transmitted from the image formation apparatus 2, the server 6 transmits image data designated in the HTML file. According to the embodiment, only one server 6 is shown, but the source servers of the HTML file and the image data may differ from one another. Similar to the case of acquisition of the HTML file, the non-operational state of the operation panel 8 continues during the period until completion of the acquisition of the image data. The time required for completion of the acquisition of image data varies depending on the performance of the server 6 and the load state of the network 4.

Therefore, when the non-operational state of the operation panel 8 continues for a predetermined timer period, the time measurement of the timer of the reset unit of the image formation apparatus 2 is completed (step S102). At this point, the screen display controller 12 determines whether or not the image formation apparatus 2 is obtaining, from the server 6, a file for forming the operation screen (step S103). In this case, the HTML file has been obtained. Then, the screen display controller 12 checks whether or not data are being obtained from an external device 6 through execution of processing of the HTML file (step S104), which can be determined by monitoring the execution of the HTML file or monitoring operations of the communication processor 14. In the example provided, the screen display controller 12 resets the timer without activating the reset unit and returns to the time measuring process (step S101) because the image data are being obtained. Even if the timer period elapses, the operation screen displayed on the operation panel 8 is not reset. In other words, the operation screen is not reset until the image data are obtained and execution of the processing of the HTML file is completed, which is convenient for the user. When the acquisition of image data is completed in this manner, the screen display controller 12 completes an operation screen using the obtained HTML file and image data and displays the operation screen on the operation panel 8.

When the HTML file is not being obtained and data are not being obtained from the external device 6 in the processing of the HTML file, the screen display controller 12 determines that there is no cooperation with an external device, and activates the reset unit (step S105).

According to the present embodiment, when the image formation apparatus is cooperating with an external device such as acquisition of data via the network 4, the reset unit is not activated; that is, the reset unit is inhibited, even if a non-operational state of the operation panel 8 continues for a predetermined period. With this structure, wasting of past input of the setting of conditions from the operation panel 8 can be prevented.

In the present embodiment, an HTML file is obtained from an external device as a file for forming a screen to be displayed on the operation panel 8, but the image forming file is not limited to the HTML file and, for example, a CGI (Common Gateway Interface) program may alternatively be used.

In addition, the present embodiment has been conceived to eliminate inconvenience due to activation of the reset unit intrinsic to the image formation apparatus 2, that is, a function of automatically initializing the settings from the operation panel 8 when a non-operational state of the operation panel 8 continues for a predetermined period. While an automatic clear function and a power save function are examples of functions corresponding to the reset unit, the reset unit is not limited to these functions, and, when a new function corresponding to a function of automatically initializing the settings from the operation panel 8 becomes available, such a new function also corresponds to the reset unit according to the present embodiment.

Moreover, according to an aspect of the invention, an image formation apparatus has a timer, a reset unit and a controller. The timer measures time for a non-operation state of the image formation apparatus. Also, the reset unit initializes a setting of the image formation apparatus when the non-operation state continues for a predetermined period. The controller inhibits the reset unit from executing the initialization when the image formation apparatus communicates with an external device, even if the non-operation state continues for the predetermined period.

As described above, according to an aspect of the present invention, there is provided an image formation apparatus having a timer for measuring time of a non-operation state of an operation screen and a reset unit for initializing a setting from the operation screen when the non-operation state of the operation screen continues for a predetermined period, the image formation apparatus comprising a controller which inhibits the reset unit if an execution file which cooperates with an external device is being executed or data are being exchanged with the external device when the non-operation state of the operation screen continues for the predetermined period.

According to another aspect of the present invention, preferably, in the image formation apparatus, the execution file is obtained from the external device and forms display content of the operation screen.

According to another aspect of the present invention, preferably, in the image formation apparatus, the controller inhibits the reset function until completion of data acquisition from the external device in accordance with a description of the execution file.

According to another aspect of the present invention, preferably, in the image formation apparatus, when the non-operation state of the operation screen continues for the predetermined period, the reset unit is an automatic clear function which executes an initialization process of the settings from the operation screen and a display state or a power save function which stops supply of power to the operation screen in addition to the initialization process.

According to another aspect of the present invention, there is provided a control method of operation screen display executed by a computer provided in an image formation apparatus and having a timer for measuring time of a non-operation state of an operation screen and a reset unit for initializing a setting from the operation screen when the non-operation state of the operation screen continues for a predetermined period, wherein the reset unit is inhibited if an execution file which cooperates with an external device is being executed or data are being exchanged with the external device when the non-operation state of the operation screen continues for the predetermined period.

According to another aspect of the present invention, there is provided a control program of an operation screen display which allows a computer, provided in an image formation apparatus and having a timer function for measuring time of a non-operation state with respect to an operation screen and a reset function for initializing a setting from the operation screen when the non-operation state of the operation screen continues for a predetermined period, to function as a unit which inhibits the reset function if an execution file which cooperates with an external device is being executed or data are being exchanged with the external device when the non-operation state of the operation screen continues for the predetermined period.

According to another aspect of the present invention, activation of a function for initializing the operation screen before completion of communication process with an external device caused by a user operation from the operation screen is inhibited. Therefore, the input of condition settings or the like input from the operation screen is not wasted.

The entire disclosure of Japanese Patent Application No. 2004-321184 including specification, claims, drawings, and abstract is incorporated herein by reference.

What is claimed is:

1. An image formation apparatus comprising:

an operation panel;

a timer to measure an amount of time that has elapsed since a last instance of user-based operation of said operation panel;

a reset unit to initialize a setting, corresponding to an operation condition of the image formation apparatus which has been changed by a user, when the time measured by said timer exceeds a predetermined amount of time; and a controller to control operations of the image formation apparatus;

said controller inhibiting said reset unit from initializing the setting, corresponding to an operation condition of the image formation apparatus which has been changed by the user, in response to said controller being in a state of waiting, said state of waiting being invoked by said controller waiting for an operation to be executed upon data, received from an external device, to be completed;

said controller inhibiting said reset unit from initializing the setting when an execution file that cooperates with an external device is executed or data is exchanged with the external device, the execution file being obtained from the external device, and said operation panel displays information based upon the execution file.

2. The image formation apparatus according to claim 1, wherein the operation associated with the setting, corresponding to an operation condition of the image formation apparatus which has been changed by the user, is based upon instructions within an execution file obtained from the external device.

3. The image formation apparatus according to claim 1, wherein said controller inhibits said reset unit from initializing the setting, corresponding to an operation condition of the image formation apparatus which has been changed by the user, until data acquisition from an external device is completed.

4. The image formation apparatus according to claim 1, wherein said reset unit inhibits a supply of power to said operation panel when the time measured by said timer exceeds a predetermined amount of time.

5. A control method for an image formation apparatus comprising:

measuring an amount of time that has elapsed since a user-based operation of an operation panel;

initializing a setting, corresponding to an operation condition of the image formation apparatus which has been changed by a user, when the measured time exceeds a predetermined amount of time;

inhibiting the initialization process in response to the image formation apparatus being in a state of waiting, the state of waiting being invoked by the image formation apparatus waiting for an operation to be executed upon data, received from an external device, to be completed;

inhibiting the initialization process when an execution file that cooperates with an external device is executed or data is exchanged with the external device, the execution file being obtained from the external device, and displaying information based upon the execution file.

6. The control method according to claim 5, wherein the operation associated with the setting, corresponding to an operation condition of the image formation apparatus which has been changed by the user, is based upon instructions within an execution file obtained from the external device.

7. The control method according to claim 5, wherein the initializing process is inhibited until data acquisition from an external device is completed.

8. A storage medium readable by a computer, comprising:

a program of instruction code executable by a computer;

said program of instruction code including, first instructions to enable the computer to measure an amount of time that has elapsed since a user-based operation of an operation panel, second instructions to enable the computer to initialize a setting, corresponding to an operation condition of the image formation apparatus which has been changed by a user, when the measured time exceeds a predetermined amount of time, and third instructions to enable the computer to inhibit the initialization process in response to the computer being in a state of waiting, the state of waiting being invoked by the computer waiting for an operation to be executed upon data, received from an external device, to be completed;

said third instructions enabling the computer to inhibit the initialization process when an execution file that cooperates with an external device is executed or data is exchanged with the external device, the execution file being obtained from the external device, and an operation panel displays information based upon the execution file.

9. The storage medium according to claim 8, wherein the operation associated with the setting, corresponding to an operation condition of the image formation apparatus which has been changed by the user, is based upon instructions within an execution file obtained from the external device.

10. The storage medium according to claim 8, wherein the initialization process is inhibited until data acquisition from an external device is completed.

11. An image formation apparatus comprising:

a timer to measures an amount of time that has elapsed since an operational state of the image formation apparatus;

a reset unit to initialize a user-changed setting of the image formation apparatus when the time measured by said timer exceeds a predetermined amount of time; and a controller to inhibit said reset unit from initializing the user-changed setting of the image formation when the image formation apparatus is in a state of waiting, said state of waiting being invoked by the controller waiting for an operation to be executed upon data, received from an external device, to be completed;

said controller inhibiting said reset unit from initializing the setting when an execution file that cooperates with an external device is executed or data is exchanged with the external device, the execution file being obtained from the external device, and an operation panel displays information based upon the execution file.

12. The image formation apparatus according to claim 1, wherein said reset unit executes a process of initializing a display state of the operation screen when the time measured by said timer exceeds a predetermined amount of time.

13. The control method according to claim 5, further comprising:

initializing a display state of an operation screen when the measured time exceeds a predetermined amount of time.

14. The storage medium according to claim 8, further comprising:

a fourth instruction to initialize a display state of an operation screen when the measured time exceeds a predetermined amount of time.

* * * * *